United States Patent [19]

Vos et al.

[11] 4,168,335

[45] Sep. 18, 1979

[54] UNDERWATER TERRAIN REINFORCEMENT MATTING

[75] Inventors: Jan G. Vos, Dieren, Netherlands; Berthold H. Daimler, Remscheid-Lennep, Fed. Rep. of Germany; Wilhelm Herveling, Wuppertal, Fed. Rep. of Germany; Alfred Birker, Neviges-Dönberg, Fed. Rep. of Germany; Siegfried Langefeld, Wuppertal, Fed. Rep. of Germany

[73] Assignee: Akzona Incorporated, Asheville, N.C.

[21] Appl. No.: 879,938

[22] Filed: Feb. 22, 1978

Related U.S. Application Data

[63] Continuation of Ser. No. 788,215, Apr. 18, 1977, abandoned, which is a continuation of Ser. No. 318,883, Dec. 27, 1972, abandoned.

[30] Foreign Application Priority Data

Dec. 28, 1971 [DE] Fed. Rep. of Germany ... 7149047[U]

[51] Int. Cl.[2] ..... B32B 3/00

[52] U.S. Cl. ..... 428/58; 405/16; 405/19; 428/53; 428/288; 428/296

[58] Field of Search ..... 428/44, 296, 288, 198, 428/53, 57, 58; 114/229; 5/344; 9/13; 61/37, 38, 2, 3; 52/169, 309; 405/19, 16, 17, 23

[56] References Cited

U.S. PATENT DOCUMENTS

| | | | |
|---|---|---|---|
| 1,573,909 | 2/1926 | Blumberg | 114/229 |
| 3,517,514 | 6/1970 | Visser | 61/38 |
| 3,687,759 | 8/1972 | Werner et al. | 156/167 |
| 3,691,004 | 9/1972 | Werner et al. | 428/219 |

*Primary Examiner*—Lorraine T. Kendell
*Attorney, Agent, or Firm*—Francis W. Young; Tom R. Vestal

[57] ABSTRACT

A matting is disclosed for reinforcing underwater terrains. The matting is made of sections of looped intersecting synthetic polymer filaments bonded to one another at their points of intersection, at least one section being temporarily buoyant in water. The matting disclosed may be towed into position and then submerged.

5 Claims, 8 Drawing Figures

UNDERWATER TERRAIN REINFORCEMENT MATTING

This is a continuation of application Ser. No. 788,215, filed Apr. 18, 1977, now abandoned, which was a continuation of application Ser. No. 318,883, filed Dec. 27, 1972, now abandoned.

It is known that erosion of underwater slopes and surfaces has a deleterious effect on the operation of narrow water channels and basins which are subjected to the constant passing of naval vessels. For instance, in marine harbors having dredged channels for passage of boats, the channels are continuously subjected to sedimentation caused by erosion of the underwater surfaces nearby due to the churning action of the passing vessels.

One means for reducing these erosive effects has been to install concrete pilings or fortifications in the area being subjected to the erosive water forces. While this has proven to be beneficial in controlling erosion, the method is expensive and can cause serious damage to vessels unfortunate enough to come into contact with it.

The present invention utilizes a suitable, non-woven matting as an alternative and/or supplement to the concrete piling fortifications. It has been found that such matting manufactured and in accordance with the teachings herein provide an inexpensive and effective reinforcement of underwater surfaces, and is readily installable.

The non-woven matting may consist of reinforced staple fiber. Preferably, however, the matting is made in accordance with the teachings formed in U.S. Pat No. 3,691,004. The matting therein is comprised of a plurality of looped, continuous synthetic polymer filaments, in which the filaments are superficially bonded together at their points of intersection. The advantage of such a matting lies in its open, low density structure. This structure allows sand, plant growth and other particles to become easily entrapped within the matting. The entrapped particles act as effective anchors for the matting and allow the matting to acceptably and effective blend into the underwater landscape.

The matting preferably should be the approximate density of the water in which it will be placed—salt or fresh. Furthermore, the non-woven, if constructed under the above mentioned teachings, need not be in the form of matting, but may be in the form of elongated bodies. For example, the body shape may be rectangular, square, round, or of other cross-sections. The cross-section may also be of uniform density, variable density, or be hollow. The latter may be effectively utilized, as will be described in more detail herein.

The present invention utilizes a non-woven structure, floatable until the structure has been towed into position. Preferably, the structure is made of a series of elongated bodies joined together, certain of the bodies capable of buoying the structure until it has been towed into position for installation.

Various methods may be used to make certain of the bodies sufficiently buoyant for towing purposes. For instance, the individual bodies may be coated with a film impermeable to water. The impermeable film can then be punctured or destroyed when the structure is in position for sinking.

Further, use can be made of a film being water permeable, but with the permeability being sufficiently low to allow the structure to be towed into position with sufficient buoyancy, then later absorbing sufficient water into the buoyant bodies to allow the matting structure to sink. Ballast, such as dredgings, refuse, or whatever, may be used to hasten the sinking.

It can be seen that a reinforcement such as the present invention is very conducive to the growth or settlement of aquatic plants and animals, and will lend itself very beneficially into the seascape structure. The invention will be described more completely with reference to the following figures.

Figure 1:
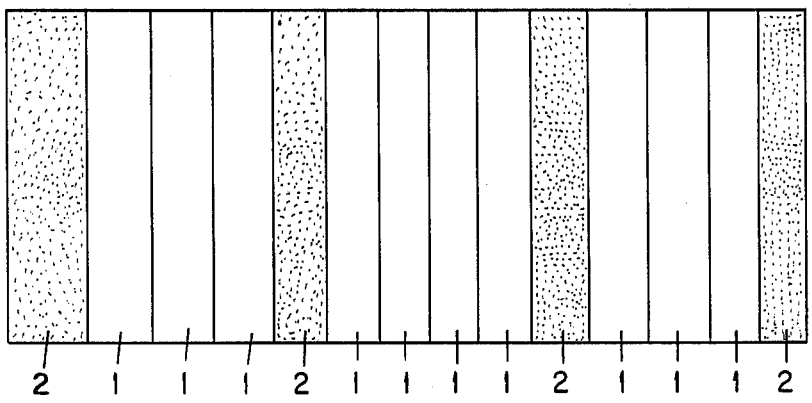
FIG. 1 is a schematic of the top view of one embodiment of the matting structure according to the invention.
Figure 3:
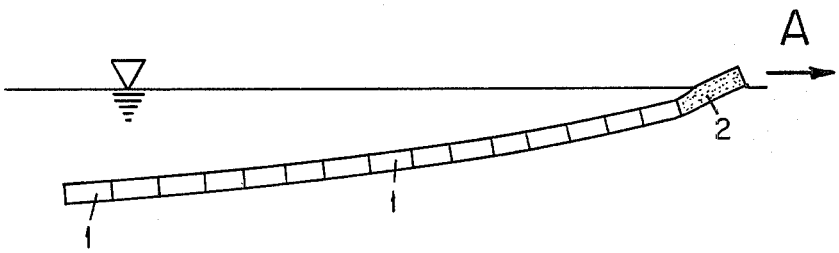
Figure 4:
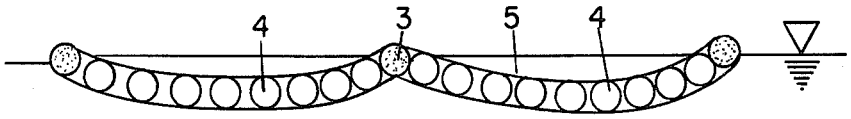
Figure 5:
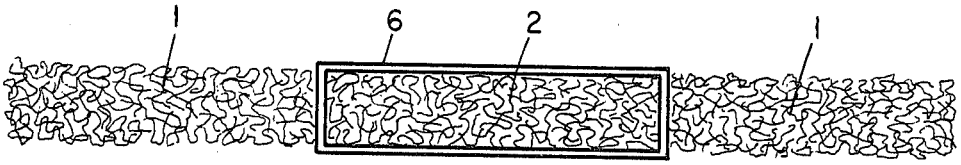
Figure 6:
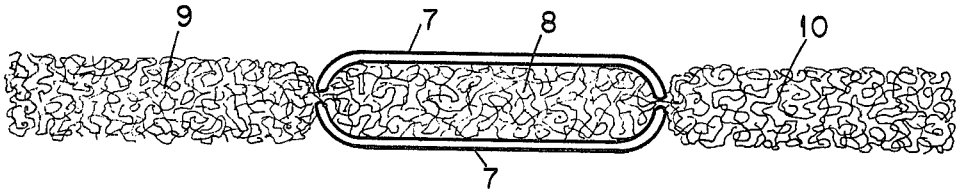
Figure 7:
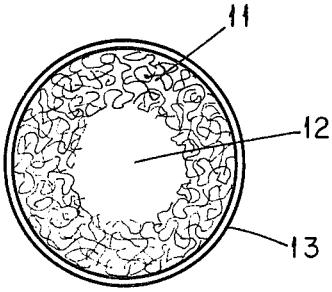
Figure 8:
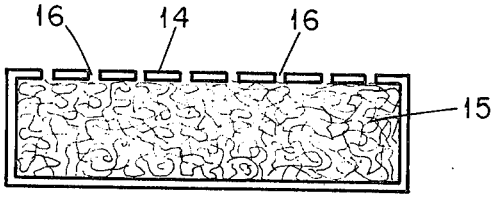

FIG. 3 schematically depicts one embodiment being towed;

FIG. 4 represents a series of round elongated bodies tied together;

FIG. 5 is a section view of the matting in FIG. 1;

FIG. 6 is an alternative embodiment of FIG. 5;

FIG. 7 is a cross-sectional view of a hollow elongated structure according to the invention;

FIG. 8 depicts a sinkable coated structure with perforations in the upper face.

Figure 2:
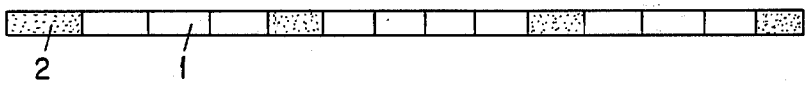
FIG. 2 is a schematic side view of FIG. 1.

As shown in FIGS. 1 and 2, a series of uncovered sinkable non-woven bodies 1 may be interconnected with buoyant bodies 2 of sufficient number to buoy the whole structure while the structure is being towed into position. The bodies may be connected in various ways. If constructed of thermoplastic material, the bodies may be fused together. Also the bodies may be cemented together or lashed together through the use of an appropriate lashing material.

FIG. 5 represents an alternative embodiment using a single buoyant structure for towing purposes. By combining one buoyant structure as shown with the remaining series being a requisite specific gravity (e.g., 1.04 grams/centimeter for polyamide 11) the structure will be suspended in sea water (specific gravity approximately 1.03 grams/centimenter) and towable in the direction of the arrow A.

In FIG. 4, a series of non-woven bodies of a circular cross-section are lashed together with certain of the bodies being covered with an impermeable or partially permeable material to add to requisite buoyancy to the whole structure.

The non-woven body structures 1 and 2 of FIG. 1 are shown in FIG. 5, with a film 6 of low or no permeability depicted on body 2. The body 2 may be completely enclosed by the film 6.

The body structure 1 and 2 are preferably constructed of a non-woven material made up of a plurality of looped, intersecting, largely amorphous, melt-spun synthetic polymer threads superficially adhering to one another at their points of intersection. As the matting is introduced to the seascape, suspended or mobile particles such as sand and vegetation become entangled among the loops of the non-woven, anchoring the matting in place. After a short time, the matting will become sufficiently anchored to prevent further erosion of the area covered by the matting.

FIG. 6 shows an alternative method of construction of the matting. Non-woven bodies 8, 9 and 10 are fused together through conventional techniques (e.g., heated rod, hot air, or solvent). Strips of an impermeable or low permeable film 7 are placed above and below the non-woven body 8 and fused together under sufficient pressure to enclose the body 8 in a watertight wrapping.

A circular elongated body 11 with film 13 sealing the body 11 is shown in FIG. 7. Of advantage is the use of such a body 11 with a hollow section 12, as the whole structure is much more buoyant initially.

FIG. 8 shows an elongated matting structure 14 covered with a film or coating 15 having perforations 16 only on its top. Use of this structure gives a temporarily buoyant structure. Lapping of waves over the top of this structure will gradually cause the structure to become submersible allowing the matting to sink to the floor of the body of water. Also a ballast may be added to the top of the matting sufficient to submerge the structure and allow water to seep through the perforations.

It is recognized that the structure of the present invention may be held in place through appropriate anchoring means until such time as the matting is to be placed in its final position.

The use of synthetic polymer filaments of a specific gravity of 0.90 to 1.38 grams per cubic centimeter are especially useful in the present invention. Those filaments having a specific gravity lower than water will tend to float and may be used as the buoying means for the matting structure. The synthetic polymer filaments made of polyethylene and polypropylene are appropriate for this purpose.

Also appropriate are synthetic polymer filaments roughly the same specific gravity as water. Use of these filaments in the matting structure reduce the number of buoyant sections required in the matting structure. Appropriate polymers for this class generally are nylon polymers, and specifically are nylon 6, nylon 6.6 and nylon 11. Polyester filaments may also be used in the construction of the matting of this invention, although of a higher specific gravity.

What is claimed is:

1. An underwater terrain reinforcement matting comprising a series of linearly connected open, low density nonwoven bodies interconnected with at least one nonwoven body which is temporarily buoyant in water, said nonwoven bodies consisting essentially of a plurality of looped, intersecting synthetic polymer filaments selected from the group consisting of polyolefin, polyester, and nylon which are adhered to one another at their points of intersection.

2. The reinforcement matting of claim 1 wherein said synthetic polymer filaments have a specific gravity of 0.90 to 1.38 grams per cubic centimeter.

3. The reinforcement matting of claim 2 wherein said synthetic polymer filaments have a specific gravity of 1.04 to 1.15 grams per cubic centimeter.

4. The reinforcement matting of claim 1 wherein said temporarily buoyant section is elongated and of circular configuration transverse to said elongation.

5. The reinforcement matting of claim 4 wherein said temporarily buoyant section is of cylindrical configuration transverse to said elongation.

* * * * *